US011488816B2

(12) United States Patent
You et al.

(10) Patent No.: US 11,488,816 B2
(45) Date of Patent: Nov. 1, 2022

(54) INTERFACE UNIT

(71) Applicant: LG Chem, Ltd., Seoul (KR)

(72) Inventors: Hyun Sik You, Daejeon (KR); Yongjin Bae, Daejeon (KR); Young Hee Lim, Daejeon (KR); Yeu Young Youn, Daejeon (KR)

(73) Assignee: LG Energy Solution, Ltd.

( * ) Notice: Subject to any disclaimer, the term of this patent is extended or adjusted under 35 U.S.C. 154(b) by 67 days.

(21) Appl. No.: 17/049,105

(22) PCT Filed: Sep. 11, 2019

(86) PCT No.: PCT/KR2019/011778
§ 371 (c)(1),
(2) Date: Oct. 20, 2020

(87) PCT Pub. No.: WO2020/055133
PCT Pub. Date: Mar. 19, 2020

(65) Prior Publication Data

US 2021/0233758 A1 Jul. 29, 2021

(30) Foreign Application Priority Data

Sep. 11, 2018 (KR) ..... 10-2018-0108208
Sep. 27, 2018 (KR) ..... 10-2018-0114885
(Continued)

(51) Int. Cl.
*H01J 49/04* (2006.01)
*H01J 49/16* (2006.01)

(52) U.S. Cl.
CPC ..... *H01J 49/0463* (2013.01); *H01J 49/168* (2013.01)

(58) Field of Classification Search
CPC ..... H01J 49/0463; H01J 49/164; H01J 49/168
See application file for complete search history.

(56) References Cited

U.S. PATENT DOCUMENTS

2006/0207115 A1* 9/2006 Truche ..... H01J 49/0418 33/286
2009/0272893 A1* 11/2009 Hieftje ..... H01J 49/0004 250/288
(Continued)

FOREIGN PATENT DOCUMENTS

CN 105021718 B 6/2017
EP 3240014 A1 11/2017
(Continued)

OTHER PUBLICATIONS

Ackerman, et al., "Assessing direct analysis in real-time-mass spectrometry (DART-MS) for the rapid identification of additives in food packaging," Food Additives and Contaminants, Dec. 2009, pp. 1611-1618, vol. 26, No. 12.
(Continued)

*Primary Examiner* — David E Smith
(74) *Attorney, Agent, or Firm* — Lerner, David, Littenberg, Krumholz & Mentlik, LLP

(57) ABSTRACT

The present invention relates to an interface unit which can be used in a laser ablation-direct analysis in real time-mass spectrometry (LA-DART-MS) system, and more particularly, provides an interface unit which can be disposed between a DART unit and an MS unit to improve detection sensitivity of a sample laser-ablated by a laser beam.

14 Claims, 10 Drawing Sheets

(30) Foreign Application Priority Data

Sep. 6, 2019 (KR) ..... 10-2019-0110755
Sep. 9, 2019 (KR) ..... 10-2019-0111487
Sep. 10, 2019 (KR) ..... 10-2019-0112165

(56) References Cited

U.S. PATENT DOCUMENTS

| | | | | |
|---|---|---|---|---|
| 2014/0287953 | A1 | 9/2014 | Gunther et al. | |
| 2016/0056031 | A1 | 2/2016 | Loboda | |
| 2016/0079050 | A1 | 3/2016 | Shimada et al. | |
| 2016/0163527 | A1 | 6/2016 | Sekimoto et al. | |
| 2016/0181079 | A1 | 6/2016 | Berkout | |
| 2016/0329203 | A1 | 11/2016 | Fujita | |
| 2016/0343559 | A1* | 11/2016 | Kinoshita ..... | H01J 49/145 |
| 2017/0103878 | A1 | 4/2017 | Kinoshita et al. | |
| 2017/0278690 | A1 | 9/2017 | Aliman et al. | |
| 2018/0330932 | A1 | 11/2018 | Takats et al. | |
| 2019/0113448 | A1 | 4/2019 | Oh et al. | |
| 2019/0293176 | A1 | 9/2019 | Hwang | |
| 2020/0055035 | A1 | 2/2020 | Zheng et al. | |

FOREIGN PATENT DOCUMENTS

| | | | |
|---|---|---|---|
| JP | H07153420 | A | 6/1995 |
| JP | 2007225285 | A | 9/2007 |
| JP | 2010014539 | A | 1/2010 |
| JP | 2014209066 | A | 11/2014 |
| JP | 2015165243 | A | 9/2015 |
| JP | 2016519393 | A | 6/2016 |
| JP | 2016522887 | A | 8/2016 |
| KR | 19990041082 | U | 12/1999 |
| KR | 20150134373 | A | 12/2015 |
| KR | 20160033162 | A | 3/2016 |
| KR | 101748525 | B1 | 6/2017 |
| KR | 20170098254 | A | 8/2017 |
| KR | 20170112438 | A | 10/2017 |
| KR | 20170120924 | A | 11/2017 |
| KR | 20170131488 | A | 11/2017 |
| KR | 20180108208 | A | 10/2018 |
| KR | 20180114885 | A | 10/2018 |
| KR | 20190110775 | A | 10/2019 |
| KR | 20190111487 | A | 10/2019 |
| KR | 20190112165 | A | 10/2019 |
| WO | 2014169394 | A1 | 10/2014 |
| WO | 2015015641 | A1 | 2/2015 |
| WO | 2015118681 | A1 | 8/2015 |

OTHER PUBLICATIONS

Cheng, et al., "Laser-based ambient mass spectrometry," Analytical Methods, May 22, 2017, pp. 4924-4935, vol. 9, No. 24.

International Search Report for Application No. PCT/KR2019/011778 dated Jan. 28, 2020, 2 pages.

Ding, X. et al., "Laser Desorption/Ablation Postionization Mass Spectrometry: Recent Progress in Bioanalytical Applications," Mass Spectrometry Reviews, Aug. 2021, pp. 566-605, vol. 40, John Wiley & Sons. XP055840795 URL:https:jjonlinelibrary.wiley.comjdoijfull-XML/10.1002/mas.21649>.

Extended European Search Report including Written Opinion for Application No. 19860396.1 dated Sep. 24, 2021, pp. 1-10.

Harris, G.A. et al., "Simulations and 1-15 Experimental Investigation of Atmospheric Transport in an Ambient Metastable-Induced Chemical Ionization Source," Analytical Chemistry, Jan. 2009, pp. 322-329, vol. 81, No. 1. XP055132263.

* cited by examiner

INTERFACE UNIT

CROSS-REFERENCE TO RELATED APPLICATIONS

The present application is a national phase entry under 35 U.S.C. § 371 of International Application No. PCT/KR2019/011778, filed on Sep. 11, 2019, published in Korean, which claims priority to Korean Patent Application No. 10-2018-0108208 filed on Sep. 11, 2018, Korean Patent Application No. 10-2018-0114885, filed on Sep. 27, 2018, Korean Patent Application No. 10-2019-011075,5 filed on Sep. 6, 2019, Korean Patent Application No. 10-2019-0111487, filed on Sep. 9, 2019, and Korean Patent Application No. 10-2019-0112165 filed on Sep. 10, 2019, and all the contents disclosed in these aforementioned patent applications are hereby incorporated by reference herein as a part of the present specification.

TECHNICAL FIELD

The present invention relates to an interface unit that can be used in a laser ablation (LA)-DART-MS system, and more specifically to an interface unit that may be configured between a Direct Analysis in Real Time (DART) unit and a mass spectrometry (MS) unit to improve detection sensitivity of a sample ablated with a laser beam.

BACKGROUND

In general, a DART-MS (Direct Analysis in Real Time-Mass Spectrometry) system is a device that can perform molecular weight and structural analysis of a material by ablating and ionizing a target material using a heated metastable He gas discharged from an ion source and reactive ions produced from it. Although this has an advantage that can perform simple analysis by locating a sample between the ion source and the MS unit under the atmospheric pressure, application to a wider range of the sample requires to develop a technology for increasing a concentration of the sample in the atmosphere and thereby improving a signal-to-noise ratio of spectrum. In this regard, ablation efficiency and ionization efficiency of the sample, efficient collection of generated ions, transmission, etc. may be important factors for improving the detection sensitivity. As a part of this effort, a laser ablation technique is applied to increase the concentration of the sample under the atmosphere, but due to exposed space in the atmosphere, it is still required to improve efficient collection of the ablated and ionized components and transmission to the mass spectrometry unit.

Accordingly, the laser ablation-DART-MS system is needed to improve the detection sensitivity by introducing a quartz tube interface between an exit of the DART ionization and an inlet of the MS unit to restrict flow of ablated components and generated ions at an irradiation point of each laser beam.

DETAILED DESCRIPTION OF THE INVENTION

Technical Problem

The present invention is to provide an interface unit that can be used in a laser ablation (LA)-DART-MS system, and more specifically to an interface unit that can be configured between a DART (Direct Analysis in Real Time) ionization unit and a MS (Mass Spectrometry) unit to improve detection sensitivity of a sample ablated with a laser beam.

Technical problems that the present invention seeks to achieve are not limited to the above-mentioned technical problem, and other technical problems not mentioned above will be clearly understood by a person who has an ordinary knowledge in the technical field to which the present invention belongs from the following description.

Technical Solution

An interface unit of the present invention comprises a tube-shaped main body which can be located between an exit of a DART ionization unit and an inlet of a mass spectrometry unit; and a first opening provided on one side surface of the main body, the first opening being configured such that an analyte ablated from a sample is introduced into the main body, wherein the interface unit is used in a laser ablation-DART-MS system and the main body may receive a helium beam emitted from the DART ionization unit and the analyte ablated from the sample and transmit them to the mass spectrometry unit.

The laser ablation-DART-MS system using the interface unit of the present invention comprises: a sample mounting unit on which the sample is mounted; an optical unit including a laser unit for irradiating the sample with a laser beam to ablate the sample; a DART ionization unit for providing a helium beam to ionize the analyte ablated from the sample; and a mass spectrometry (MS) unit for performing analysis on the ionized analyte. The laser ablation-DART-MS system further comprises an optical unit support member capable of mounting the optical unit at a desired position and supporting the optical unit, wherein the optical unit support member may be fixed to the mass spectrometry unit.

Effects of the Invention

According to the present invention, a laser ablation-DART-MS system can improve detection sensitivity by introducing a quartz tube interface between an exit of a DART ionization unit and an inlet of a MS unit to restrict flow of ablated components and generated ions at an irradiation point of each laser beam.

A main body of a first region according to the present invention is formed to be narrower as it is adjacent to a second region, whereby the helium gas emitted from the DART ionization unit and the analyte ablated from a sample are collected in a sufficient amount to be focused and transmitted to the second region together with the generated ionic components. An inner diameter of the main body in the second region is formed to be equal to or smaller than an inner diameter of the main body in the other end side of the first region, so that the gas stream received from the first region is transferred to the inlet of the mass spectrometry unit in a radial compression state, and thus the components to be analyzed can be efficiently collected and transferred.

According to the present invention, the laser ablation-DART-MS system can enhance reproducibility of an experiment by fixing a relative positional relationship between the laser and the sample. In addition, there is an advantage that can optimize the system for improving the detection sensitivity of the sample by adjusting positions of the optical units such as a laser unit using a laser support member. Further, it is possible to increase convenience of the equipment operation of the laser ablation-DART-MS system.

BEST FORM FOR IMPLEMENTATION OF THE INVENTION

Figure 1:
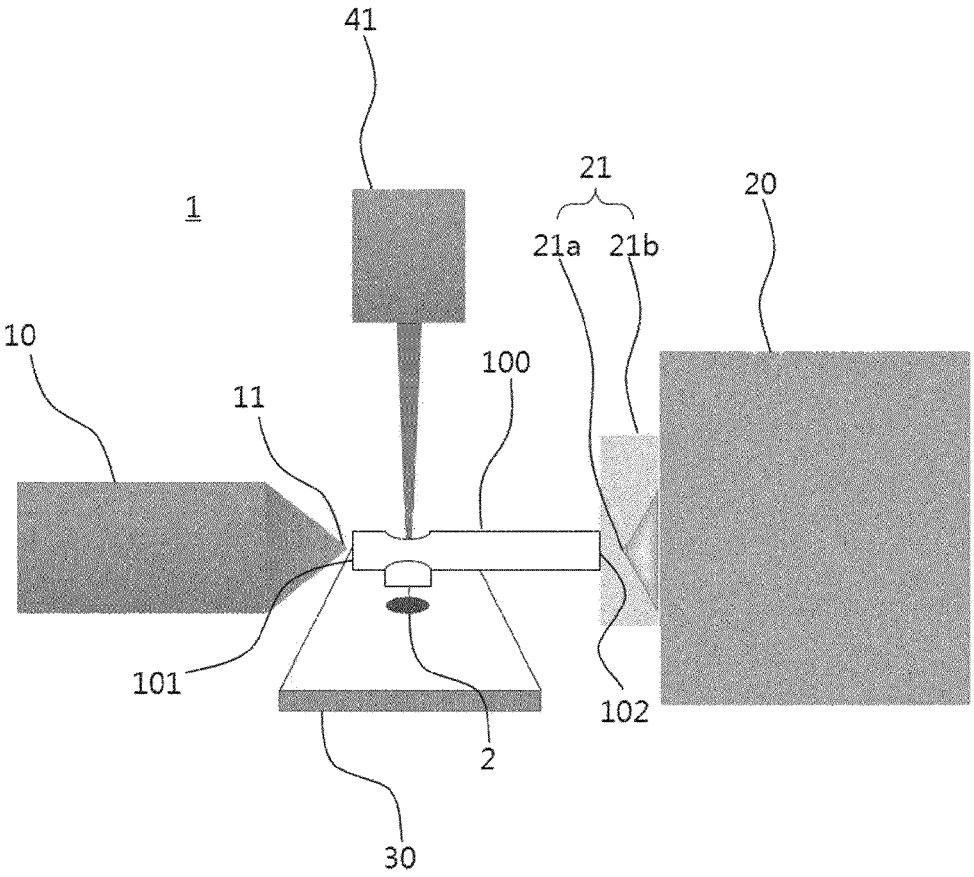
FIG. 1 is a schematic diagram of a laser ablation-DART-MS system to which an interface unit of the present invention is applied.

An interface unit of the present invention comprises a tube-shaped main body which can be located between an exit of a DART ionization unit and an inlet of a mass spectrometry unit; and a first opening provided on one side surface of the main body, the first opening being configured such that an analyte ablated from a sample is introduced into the main body, wherein the interface unit is used in a laser ablation-DART-MS system and the main body may receive a helium beam emitted from the DART ionization unit and the analyte ablated from the sample and transfer them to the mass spectrometry unit.

In the interface unit of the present invention, the main body includes a first region into which a helium beam emitted from the DART ionization unit and an analyte ablated from the sample are introduced, and a second region that is connected to the first region and into which a gas stream is injected from the first region to transfer it to the mass spectrometry unit, wherein the helium beam emitted from the DART ionization unit is introduced into one end of the first region and the other end of the first region is connected to the second region, and wherein an inner diameter of the main body in the first region may be reduced from the one end of the first region toward the other end of the first region.

In the first region of the interface unit of the present invention, an internal space of the main body may be formed to be tapered.

In the interface unit of the present invention, the first opening may be provided in the first region.

The interface unit of the present invention further comprises a protrusion tube extending from the first opening toward a sample mounting unit perpendicular to a longitudinal direction of the interface unit, wherein the analytes ablated from the sample mounted on the sample mounting unit may be introduced into the interface unit through the protrusion tube and then through the first opening.

In the interface unit of the present invention, the other side surface of the main body in the first region is provided with a second opening configured to pass through a laser beam emitted from a laser unit. The second opening faces the first opening and the laser beam may be irradiated to the sample through the first opening and the second opening.

The first region of the interface unit of the present invention may be provided with at least one or more third openings through which a corona pin is inserted into the main body.

An inlet of the mass spectrometry unit in the interface unit of the present invention includes an orifice provided with a hole through which an analyte outside the mass spectrometry unit is introduced into an analysis space provided inside the mass spectrometry unit, and an interface flange connected to the orifice. One end of the second region is connected to the other end of the first region and the other end of the second region is connected to the inlet of the mass spectrometry unit, wherein an outer diameter of the body in the other end of the second region may be smaller than an inner diameter of a suction hole formed to face the hole of the orifice in the interface flange.

The interface unit of the present invention further comprises a second opening configured to pass through the laser beam emitted from the laser unit, wherein the second opening is located at a point opposite to the first opening in the side of the main body and the laser beam may be irradiated to the sample through the second opening and then through the first opening.

The interface unit of the present invention may further comprise one or more third openings arranged to insert an end of the corona pin inside the main body of the interface unit, the third openings being located near the second openings.

The laser ablation-DART-MS system using the interface unit of the present invention comprises: a sample mounting unit on which the sample is mounted; an optical unit including a laser unit for irradiating a laser beam to the sample to ablate the sample; a DART ionization unit for providing a helium beam to ionize the analyte ablated from the sample; and a mass spectrometry (MS) unit for performing analysis on the ionized analyte. The laser ablation-DART-MS system further comprises an optical unit support member capable of mounting the optical unit at a desired position and supporting the optical unit, wherein the optical unit support member may be fixed to the mass spectrometry unit.

An inlet of the mass spectrometry unit in the laser ablation-DART-MS system of the present invention includes an orifice provided with a hole through which an analyte outside the mass spectrometry unit is introduced into an analysis space provided inside the mass spectrometry unit, and an interface flange connected to the orifice, wherein the interface flange is fixed to a surface of the mass spectrometry unit having the orifice, and the optical unit support member is fixed to the interface flange.

The optical unit support member in the laser ablation-DART-MS system of the present invention includes a plurality of fastening portions, wherein the plurality of fastening portions includes at least one interface flange connecting portion provided at a position corresponding to a tab portion of the interface flange and each interface flange connecting portion may be coupled to the tab portion of each interface flange with a first fastening member.

The plurality of fastening portions in the laser ablation-DART-MS system of the present invention further includes at least one optical unit connecting portion to which the optical unit may be coupled, wherein each optical unit connecting portion is coupled to a fastening portion of the optical unit with a second fastening member and the optical unit may further include at least one of a mirror, a translation stage, an iris, and a lens.

The optical unit support member in the laser ablation-DART-MS system of the present invention consists of an upper plate and a lower plate, and the plurality of fastening portions includes at least one upper and lower plate coupling portion to which the upper plate and the lower plate are coupled with each other and may be fixed at a position on which the upper and lower plate coupling portion of the lower plate and the upper and lower plate coupling portion of the upper plate are overlapped, by a third fastening member.

Detailed Description of the Embodiments

Hereinafter, an interface unit 100 according to an embodiment of the present invention will be described in detail. The accompanying drawings show example forms of the present invention, which are provided to explain the present invention in more detail, and the technical scope of the present invention is not limited thereto.

Further, regardless of the reference numerals, the same or corresponding constitutive elements will be given the same reference numerals, and redundant description thereof will be omitted herein. For convenience of the description, sizes and shapes of each constitutive element as shown may be exaggerated or reduced.

FIG. 1 is a schematic diagram of a laser ablation-DART-MS system 1. First, the laser ablation-DART-MS system 1 is a device that performs a molecular weight and a structural analysis of a sample 2 by irradiating the sample 2 with a laser beam to ablate the sample 2, and then ionizing an ablated analyte using a helium beam (He beam) emitted from a DART ionization unit 10 (DART ion source) and reactive ions produced therefrom.

The laser ablation-DART-MS system 1 comprises a DART ionization unit 10, a mass spectrometry unit 20, a sample mounting unit 30, a laser unit 41, and a corona discharge unit (not shown).

The DART ionization unit 10 irradiates a laser beam with the laser unit 41 and ionizes an analyte ablated from a sample 2 mounted on the sample mounting unit 30 using a helium beam emitted from the DART ionization unit 10 and reactive ions generated therefrom. The helium beam is emitted from an exit 11 of the DART ionization unit 10 to ionize the analyte ablated from the sample 2 mounted on the sample mounting unit 30. The DART ionization unit 10 may be, for example, DART-SVP manufactured by IonSense.

The mass spectrometry (MS) unit 20 receives the ionized analyte and performs a molecular weight and a structural analysis of the ionized analyte. The mass spectrometry unit 20 may be, for example, LTQ Orbitrap Elite manufactured by Thermo Fisher Scientific.

The sample mounting unit 30 is located between an exit of the DART ionization unit 10 and an inlet 21 of the mass spectrometry unit 20. The inlet 21 of the mass spectrometry unit 20 may include an orifice 21*a* having a hole through which an external analyte is introduced into an analysis space provided inside the mass spectrometry unit 20, and an interface flange 21*b* connected to the orifice 21*a*. The interface flange 21*b* in the inlet 21 of the mass spectrometry unit 20 may selectively be provided according to an analysis situation. The analyte ablated from the sample 2 mounted on the sample mounting unit 30 is introduced into the inlet of the mass spectrometry unit 20. More concretely, the sample mounting unit 30 is may be located at a predetermined distance spaced away from a virtual straight line connecting the exit of the DART ionization unit 10 and the inlet of the mass spectrometry unit 20. For example, the sample mounting unit 30 may be located downward a path between the exit of the DART ionization unit 10 and the inlet 21 of the mass spectrometry unit 20. The sample mounting unit 30 may be, for example, a sample plate of a stainless steel on which a glass substrate or a thin layer chromatography (TLC) substrate containing the sample 2 may be placed.

The laser unit 41 irradiates a sample 2 with a laser beam to ablate an analyte from the sample 2. The laser unit 41 may be, for example, LMD-XT series manufactured by LASOS.

Further, the corona discharge unit includes a corona pin. The corona pin is directed toward a path between the exit of the DART ionization unit 10 and the inlet 21 of the mass spectrometry unit 20. That is, the corona pin is directed toward an area at which the helium beam emitted from the DART ionization unit 10 meets with the analyte ablated from the sample 2. The ionization of the analyte ablated from the sample 2 is facilitated by a high voltage of the corona discharge unit, for example, a positive DC voltage of 1 kV or more, thereby increasing ionization efficiency of the analyte.

While a mass spectrum is checked in a real time by the analyzer, a relative position of the laser unit 41 or an irradiation angle and power of the laser beam can be adjusted so that an ion peak intensity of the analyte derived from the sample 2 is maximized.

Figure 2:
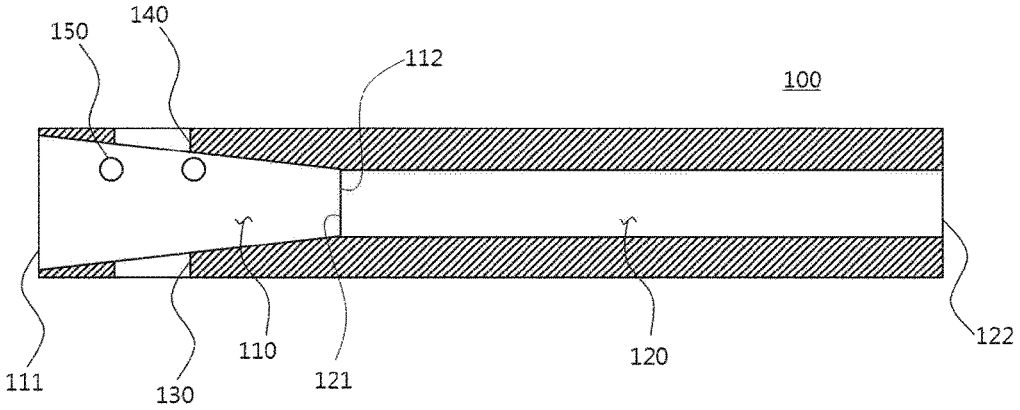
FIG. 2 is a longitudinal sectional view showing an embodiment of an interface unit of the present invention.

An interface unit 100 of the present invention may be located between the exit of the DART ionization unit 10 and the inlet 21 of the mass spectrometry unit 20 in the laser ablation-DART-MS system 1. FIG. 2 is a longitudinal sectional view of the interface unit 100 according to an embodiment of the present invention.

The interface unit 100 may have a tube-shaped main body having both ends opened, and be a tube including a plurality of openings as will be described below. The interface unit 100 may be, for example, a quartz tube including a plurality of openings. Alternatively, the interface unit 100 may be a tube made of a glass or a ceramic, in addition to the above-described quartz. One end 101 of both the ends of the interface unit 100 may be arranged to overlap an end portion of the exit of the DART ionization unit 10 (that is, some or all of the end portion of the exit of the DART ionization unit 10 is built inside one end of the interface unit 100). Alternatively, one end 101 of both the ends of the interface unit 100 may directly contact or be adjacent to the exit of the DART ionization unit 10. A helium beam emitted from the exit of the DART ionization unit 10 is introduced into the interface unit 100 through the opened one end 101 of the interface unit 100. The other end 102 of both the ends of the interface unit 100 may be coupled with an inlet of the mass spectrometry unit 20. For example, the inlet 21 of the mass spectrometry unit 20 may include an interface flange 21*b* for connecting an external tube and the mass spectrometry unit 20, wherein the other end 102 of the interface unit 100 may be inserted into the interface flange 21*b* such that the interface unit 100 and the inlet 21 of the mass spectrometry unit 20 may be coupled with each other. The interface unit 100 may be connected to the inlet 21 of the mass spectrometry unit 20 to be in contact to the orifice 21*a* or to be spaced apart by a predetermined distance (about 2 mm).

Alternatively, for example, the inlet 21 of the mass spectrometry unit 20 further includes an extension tube 21*c* fixed to the interface flange 21*b* and transferring a gas stream to the orifice 21*a* and the extension tube 21*c* may be fixed to the interface unit 100.

As shown in FIG. 2, the interface unit 100 of the present invention includes a tube-shaped main body that can be located between the exit of the DART ionization unit 10 and the inlet 21 of the mass spectrometry unit 20. The main body may include a first region 110 into which the helium beam emitted from the DART ionization unit 10 and the analyte ablated from the sample 2 are introduced, and a second region 120 connected to the first region 110 and having a gas stream of the first region 110 injected and transferred to the mass spectrometry unit 20. The gas stream may include a helium gas and components ablated and ionized from the sample. Specifically, the body of the second region 120 may be coupled with the inlet 21 of the mass spectrometry unit 20.

Specifically, one end 111 of the first region 110 faces the DART ionization unit 10 to be adjacent to the DART ionization unit 10 and the other end 112 of the first region 110 is connected to one end of the second region 120. The other end 122 of the second region 120 faces the mass spectrometry unit 20 to be adjacent to the mass spectrometry unit 20. That is, they may be arranged in the order of [DART ionization unit 10]—[first region 110]—[second region 120]—[mass spectrometry unit 20].

Figure 3:
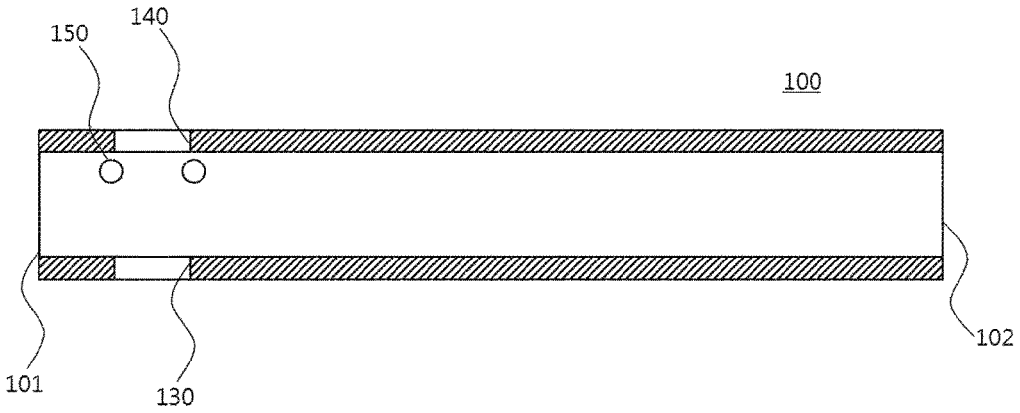
FIG. 3 is a longitudinal sectional view showing the other embodiment of an interface unit of the present invention.

Alternatively, as shown in FIG. 3, the interface unit 100 may be configured to have a uniform inner diameter along a longitudinal direction thereof.

Figure 4:
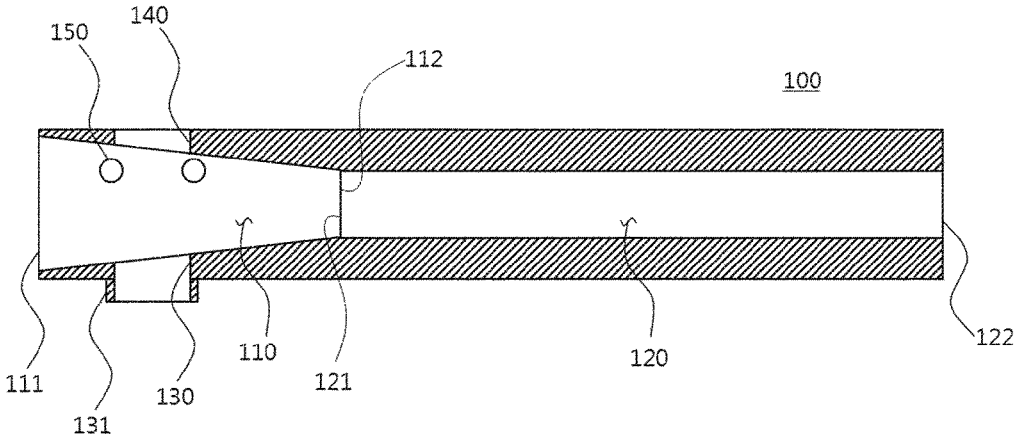
FIG. 4 is a longitudinal sectional view showing an embodiment in which a protrusion tube is provided in an interface unit of the present invention.
Figure 5:
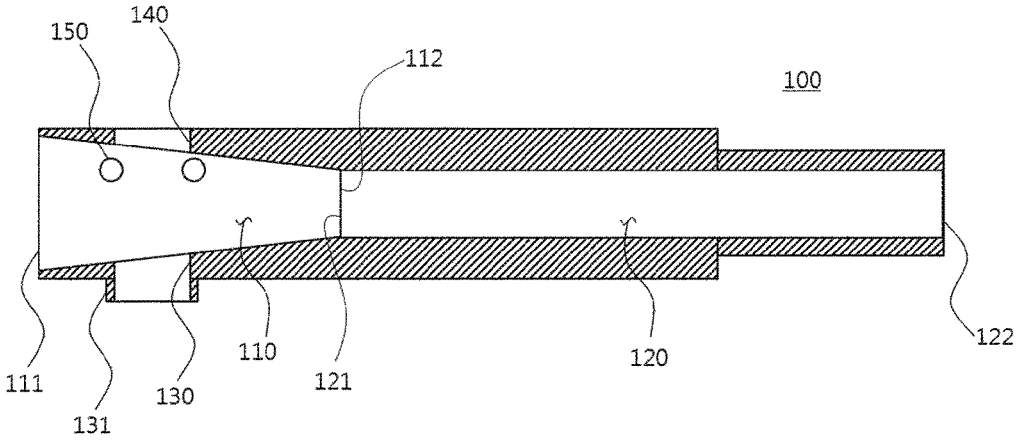
FIG. 5 is a longitudinal sectional view showing the other embodiment in which a protrusion tube is provided in an interface unit of the present invention.
Figure 6:
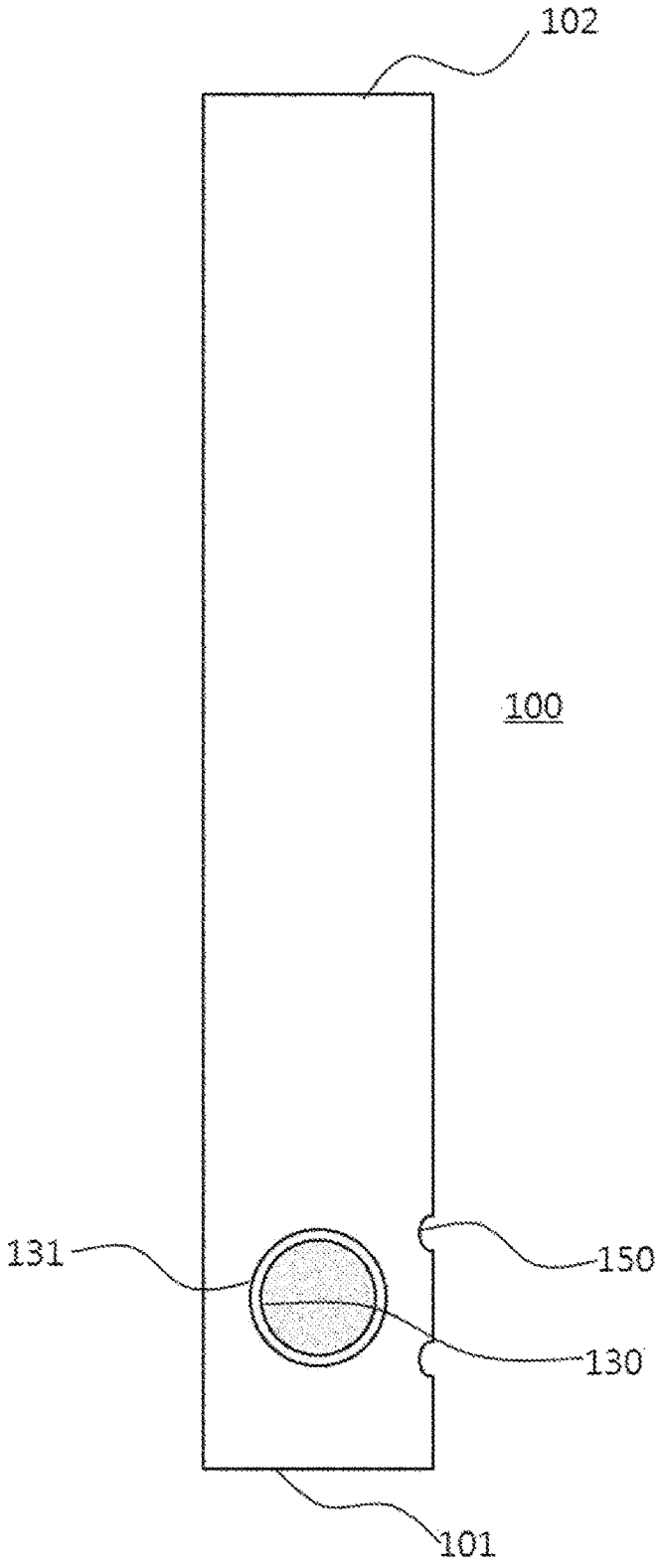
FIG. 6 is a bottom view illustrating the interface unit of FIG. 4.

As shown in FIGS. 2, 4 and 5, the inner diameter of the main body in the first region 110 may be decreased from one end 111 of the first region 110 toward the other end 112 of the first region 110. Specifically, an internal space of the main body in the first region 110 may be configured to be tapered. That is, the internal space of the main body in the first region 110 may have a conical shape. The main body in the first region 110 of the present invention is configured to be narrower as it is adjacent to the second region 120, so that a helium gas emitted from the DART ionization unit 10 and an analyte ablated from a sample 2 can be collected in a sufficient amount to be focused and transferred to the second region 120 together with the generated ionic components. The inner diameter of the main body at one end 111 of the first region 110 may be larger than the inner diameter of the inlet of the mass spectrometry unit 20.

The inner diameter of the main body in the second region 120 is configured to be equal to or smaller than the inner diameter of the main body in the other end 112 of the first region 110, and thus a gas stream transmitted from the first region 110 can be transferred to the inlet of the mass spectrometry unit 20 in radial compression. The inner diameter of the main body in the second region 120 may be kept constant. Specifically, since the gas stream is transferred in radial compression through the second region 120, it is possible to reduce a loss in the vicinity of the inlet of the mass spectrometry unit 20, which is a sub-ambient pressure region.

As shown in FIGS. 2 and 4 to 6, the first region 110 may include a sample mounting unit 30, more specifically, a first opening 130 formed on one side of the main body adjacent to the sample 2, a second opening 140 formed on the other side of the main body so that the laser beam emitted from the laser unit 41 passes through, and at least one third opening 150 for inserting a corona pin into the body.

The analyte ablated from the sample 2 mounted on the sample mounting unit 30 may be introduced into the interface unit 100 of the first region 110 through the first opening 130.

The analyte introduced into the interface unit 100 may be ionized by a helium beam irradiated through an opened end 101 of the interface unit 100 and reactive ions generated therefrom. The first opening 130 is also a path through which the laser beam introduced through the second opening 140 passes toward the sample 2, as will be described later. That is, the laser beam emitted from the laser unit 41 may firstly pass through the second opening 140 and then the first opening 130 to irradiate the sample 2 mounted on the sample mounting unit 30. The first opening 130 may have, for example, a circular shape.

Since the laser beam emitted from the laser unit 41 is irradiated to the sample 2 mounted on the sample mounting unit 30, the second opening 140 may be located at a point opposite to the first opening 130. That is, the second opening 140 may face the first opening 130. The second opening 140 may have, for example, a circular shape. The laser beam may penetrate the center of the second opening 140.

The second opening 140 may be covered with a planar cover of a material that transmits light in the wavelength range of the laser beam. For example, the planar cover may cover the second opening 140 such that the plane of the planar cover is perpendicular to a light path of the laser beam. As such, by covering the second opening 140 with the planar cover, the gas stream can be irradiated onto the sample without refracting or scattering the laser beam simultaneously with preventing the gas stream from leaking through the second opening 140.

Further, at least one third opening 150 may be included in a portion of the side surface of the interface unit 100 that is directed toward the corona pin of a corona discharge unit. In addition, the third opening 150 may be located near the second opening 140. An end of the corona pin of the corona discharge unit may be located near the third opening 150 to face the inside of the interface unit 100, or the end of the corona pin of the corona discharge unit may be inserted into interface unit 100 through the third opening 150. The third opening 150 applied to the corona pin may be provided in the number of one or a plurality. In case the plurality of third openings 150 are provided and each of the third openings 150 is provided at various distances from the second opening 140, the distance between the laser beam and the corona pin may be variously changed. In addition, the third opening 150 may have, for example, a circular shape.

FIGS. 4 and 5 are longitudinal cross-sectional views showing a structure in which a protrusion tube 131 is included in the interface unit 100 of the present invention. Specifically, the first opening 130 further includes the protrusion tube 131 vertically extending from the longitudinal direction of the interface unit 100. The protrusion tube 131 extends from a first opening 130 in the direction of a sample mounting unit 30. Specifically, in the laser ablation-DART-MS system 1, the protrusion tube 131 has a shape which extends downward and protrudes. That is, the protrusion tube may be a tube which extends toward the sample mounting unit 30 perpendicular to the longitudinal direction of the interface unit 100 at the first opening. Thus, the analytes ablated from the sample 2 mounted on the sample mounting unit 30 are introduced into the interface unit 100 through the protrusion tube 131 extending from the first opening 130, so that the loss of the analytes can be prevented more efficiently. The protrusion tube 131 may be, for example, a tube shape as shown in FIGS. 4 and 5. However, the present invention is not limited to the above description, and various modifications and changes may be made, such as a tapered shape widening in the direction of the sample mounting unit 30 from the first opening 130.

As shown in FIG. 5, when one end 121 of the second region 120 is connected to the other end 112 of the first region 110 and the other end 122 of the second region 120 is connected to an inlet of the mass spectrometry unit 20, an outer diameter of the body of the other end 122 of the second region 120 may be smaller than an inner diameter of a suction hole formed to face a hole of the orifice 21*a* in the interface flange 21*b*. The other end 102 of the interface unit 100 may be inserted into the suction hole to fix the interface unit 100 to the mass spectrometry unit 20. A guide protrusion for securing a length into which the interface unit 100 is inserted may be provided at the suction hole side of the interface flange 21*b*. That is, while a dimension of the other end 102 of the interface unit 100 that is directly coupled to the inlet 21 of the mass spectrometry unit 20 is formed to be coupled to the inlet 21 in accordance with the structure and size of the inlet 21 of the mass spectrometry unit 20, the outer diameter and the inner diameter of one end 101 of the interface unit 100 are made larger to allow the helium beam emitted from the DART ionization unit 10 and the analyte ablated from the sample 2 to be sufficiently introduced into the interface.

The conventional laser ablation-DART-MS system to which the interface unit 100 of the present invention is not applied has the problem that the detection sensitivity of the analyte is low, because the ablated and ionized components may be lost due to a space exposed in the atmosphere between the exit of the DART ionization unit 10 and the inlet of the mass spectrometry unit 20 during the process of ionizing the analyte ablated from the sample 2 and introducing it into the inlet of the mass spectrometry unit 20.

However, according to the present invention, as described above, the interface unit 100 is located in a path between the exit of the DART ionization unit 10 and the inlet 21 of the mass spectrometry unit 20 and has a tube shape located between the exit of the DART ionization unit 10 and the inlet 21 of the mass spectrometry unit 20, wherein the interface unit 100 includes the first opening 130 in the portion adjacent to the sample 2. Since the interface unit 100 is connected to the exit of the DART ionization unit 10 (i.e., it may be adjacent to the exit or include some or all of the end of the exit), there is an advantage that can effectively contact the ablated components by confining flow of the helium beam.

Further, the main body of the first region 110 of the present invention is formed to be narrower as it is adjacent to the second region 120, whereby the helium gas emitted from the DART ionization unit 10 and the analyte ablated from the sample are collected in a sufficient amount to be focused and transferred to the second region 120 together with the generated ionic components. An inner diameter of the main body in the second region is formed to be equal to or smaller than an inner diameter of the main body in the other end 112 side of the first region 110, so that the gas stream received from the first region 110 is transferred to the inlet of the mass spectrometry unit 20 in a radial compression state, whereby there is an advantage that the components to be analyzed can be efficiently collected and transferred.

Furthermore, the analyte ablated from the sample 2 is introduced into the interface unit 100 through the first opening 130. Thus, there is an advantage that the ablated analyte can be collected more effectively and guided to the ionization region that contacts the helium beam.

In addition, the analyte introduced into the interface unit 100 is ionized and introduced into the inlet 21 of the mass spectrometry unit 20 along the tubular interface unit 100 with minimal loss. Thus, the laser ablation-DART-MS system 1 to which the interface unit 100 of the present invention is applied has an advantage that the detection sensitivity is significantly increased as compared with the conventional laser ablation-DART-MS system.

Figure 7A:
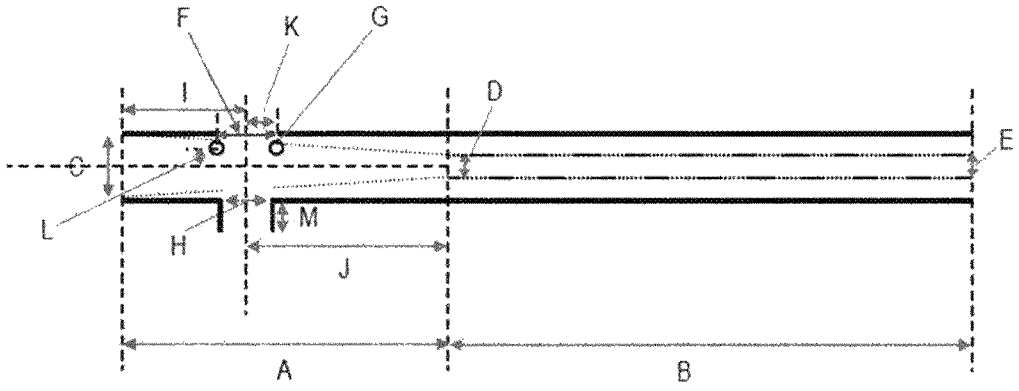
FIG. 7*a* is a conceptual diagram showing dimensions of respective portions according to an embodiment of an interface unit.

Hereinafter, specific embodiments of interface units 100 which include a first region 110 in which the inner diameter of the body varies along the longitudinal direction and a second region 120 in which the inner diameter of the body is uniform in the longitudinal direction will be described with reference to FIG. 7*a*.

The inner diameter of the main body at one end 111 of the first region 110 may be determined in consideration of an effect of the emission pattern of a helium gas emitted from a DART ionization unit 10 and a degree of the helium gas introduced into one end 101 of the interface unit 100 on the detection sensitivity of a laser ablation-DART-MS system 1. For example, the inner diameter C of the main body at one end 111 of the first region 110 may be 1 mm to 10 mm or 2 mm to 8 mm.

A length from one end 111 of the first region 110 to the other end 112 of the first region 110 and an inner diameter of the main body at the other end 112 of the first region 110 are determined in consideration of an effect of focusing of the gas stream on the detection sensitivity of the laser ablation-DART-MS system 1. For example, the length A from one end 111 of the first region 110 to the other end 112 of the first region 110 may be 10 mm to 200 mm or 10 mm to 150 mm, and the inner diameter D of the main body at the other end 112 of the first region 110 may be greater than 0 mm and less than or equal to 8 mm or between 0.5 mm and 5 mm.

Formation of the second region 120, a length from one end 121 of the second region 120 to the other end 122 of the second region 120, and an inner diameter of the main body at the second region 120 may be determined taking account of an effect of a radial compression degree of the gas stream on the detection sensitivity of the laser ablation-DART-MS system 1. For example, the length B from one end 121 of the second region 120 to the other end 122 of the second region 120 is from greater than 0 mm to 190 mm or less, or from greater than 0 mm to 140 mm or less. The inner diameter E of the main body adjacent to the mass spectrometry unit 20 at the second region 120 may range from greater than 0 mm to 8 mm or less or from 0.5 mm to 5 mm. If the second region 120 is omitted, the other end 112 of the first region 110 may be coupled to the inlet 21 of the mass spectrometry unit 20.

A first opening 130, a second opening 140, and a third opening 150 may function as follows. The first opening 130 serves to efficiently collect components ablated by the laser beam to guide them to an ionization region that contacts with the helium beam. In consideration of this, a diameter H of the first opening 130 may be from 1 mm to 5 mm or from 2 mm to 5 mm.

The second opening 140 serves to cause the laser beam to be irradiated onto a sample 2 without scattering, refracting or reflecting thereof so that effective ablation of the sample 2 can occur. The size and formation of the diameter of the second opening 140 may be determined considering that a degree of scattering and power loss of the laser beam vs a deviation degree of the analyte ablated and ionized through the second opening 140 from the interface unit 100 (that is, a loss degree of the analyte occurred by deviation of the analyte from a path between an exit of the DART ionization unit 10 and an inlet of the mass spectrometry unit 20) affect the detection sensitivity. For example, the diameter F of the second opening 140 may be between greater than 0 mm and less than or equal to 5 mm or between 2 mm and 5 mm.

The third opening 150 serves to allow a corona pin to be inserted into the interface unit 100 to facilitate ionization through high voltage supply in a region in which the helium beam and the ablated components contact and are ionized. The size, formation, and number of the diameter of the third openings 150 may be determined considering that an increase of the ionization efficiency by a corona discharge vs a deviation degree of the analyte ablated and ionized through the third opening 150 from the interface unit 100 (that is, a loss degree of the analyte occurred by deviation of the analyte from the path between the exit of the DART ionization unit 10 and the inlet of the mass spectrometry unit 20) affect the detection sensitivity. For example, the diameter G of the third opening 150 may be between greater than 0 mm and 5 mm or less, or between 1 mm and 3 mm.

Formation and length of a protrusion tube 131 may be determined considering that a degree in which the ablated analyte is introduced into the interface unit 100 to effectively contact the helium gas beam, more specifically a limitation degree of the ablated analyte (a degree to which the analyte to be ablated in the sample 2 does not flow to any other part except the region where it contacts the helium gas beam) and a guiding degree (that is, the ablated analytes flow toward the center of the interface unit 100 at which contacts the helium gas beam) vs a relative distance between an ablation point of the sample 2 and the interface unit 100 affect the detection sensitivity. For example, the length M that the protrusion tube protrudes from the first opening 130 may be between greater than 0 mm and 20 mm or less, or between greater than 0 mm and 10 mm or less.

The interface unit 100 of the present invention can be applied to the laser ablation-DART-MS system 1 so that the laser beam passes through the center of the second opening 140. The length I from one end 111 of the first region 110 to the center of the second opening 140 may be between 5 mm and 175 mm or between 5 mm and 125 mm and the length J from the center of the second opening 140 to the other end 112 of the first region 110 may be between 5 mm and 195 mm or between 5 mm and 145 mm.

The distance L from the center of the body of the interface unit 100 to the center of the third opening 150 may be between −3 mm and 3 mm or between −2 mm and 2 mm.

The distance from the center of the second opening 140 to the center of the third opening 150 may be determined in consideration of an influence of the relative distance between the laser beam and the corona pin on the detection sensitivity. For example, the distance K from the center of the second opening 140 to the center of the third opening 150 may range from 1 mm to 10 mm or from 2 mm to 6 mm.

Figure 7B:
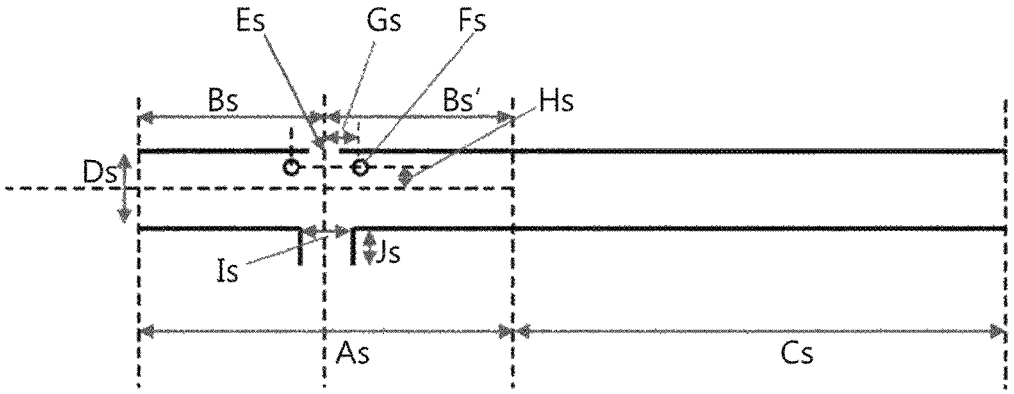
FIG. 7*b* is a conceptual diagram showing dimensions of respective portions according to the other embodiment of an interface unit.

Hereinafter, a specific embodiment of the interface unit 100 in which the inner diameter of the body is uniform along the longitudinal direction will be described with reference to FIG. 7*b*.

As refers to a distance between the exit of the DART ionization unit 10 and the inlet of the mass spectrometry unit 20, which may, for example, range from 10 mm to 200 mm or from 10 mm to 150 mm. Bs means a distance between the center of the second opening 140 and the exit of the DART ionization unit 10, which may, for example, range from 5 mm to 175 mm or from 5 mm to 125 mm. Bs' means a distance between the center of the second opening 140 and the inlet of the mass spectrometry unit 20, which may, for example, range from 5 mm to 195 mm or from 5 mm to 145 mm. Cs means a length of the portion fixed to the inlet of the mass spectrometry unit 20, which may, for example, range from 10 mm to 190 mm or from 10 mm to 140 mm. Ds means an inner diameter of one end of the DART ionization unit 10 side of the interface units 100 and 100', which may, for example, range from 1 mm to 10 mm or from 2 mm to 8 mm. Es means a diameter of the second opening 140 for passing the laser beam, which may, for example, range from greater than 0 mm to 5 mm or less or from 2 mm to 5 mm. Fs means a diameter of the third opening 150, which may, for example, range from greater than 0 mm to 5 mm or less or from 1 mm to 3 mm. Gs means a distance between the center of the second opening 140 and the center of the third opening 150, which may, for example, range from 1 mm to 10 mm or from 2 mm to 6 mm. Hs means a height from the center of the interface units 100, 100' to the center of the third opening 150, which may, for example, range from −3 mm to 3 mm or from −2 mm to 2 mm. Is refers to a diameter of the first opening 130 for passing the laser beam and ionizing the ablated analyte, which may, for example, range from 1 mm to 5 mm or from 2 mm to 5 mm. Js means a length (height) of the protrusion tube 131 extending from the first opening 130, which may, for example, range from greater than 0 mm to 10 mm or less or from greater than 0 mm to 20 mm or less. In case Js is 0 mm, the first opening 130 does not have the protrusion tube 131.

The present invention is not limited to the above-described dimensions, and may be variously changed according to various environments in which the present invention is implemented.

Example 1

Sample Preparation

A UV absorber material (C14H16N2O2, ethyl (Z)-2-cyano-3-(4-(dimethylamino)phenyl-acrylate) with a molecular weight of 244 Da was completely dissolved in PYR13-FSI (1-methyl-1-propylpyrrolidinium bis(fluorosulfonyl)imide) which is an ionic liquid in a concentration of 10 mg/mL.

Then, the ionic liquid as a solute was mixed evenly with a solvent having properties such as a low vapor pressure, a good solubility, a thermal stability, and a high viscosity, whereby the mixture can be used as a matrix having advantages of both of a liquid matrix and a solid matrix in that the solute is not volatilized. An analyte ablated from a sample 2 by a laser beam was dissolved in the ionic liquid for securing homogeneity and shot-to-shot reproducibility of the sample. Thus, when the experiment was performed using the laser ablation-DART-MS system, a signal reduction due to continuous consumption of the sample 2 during the analysis time was reduced to a minimum, so that a constant signal sensitivity can be kept.

Experimental Condition

A laser power is 180 mW as a continuous wave, a DC voltage ranging from 0 to 1.5 kV is applied to a needle, a temperature of the DART source is 400° C., and the mass spectrometry unit 20 has a positive mode (ionization mode), an FTMS (analyzer) set as 240,000 (resolution). As shown in FIG. 2, the inside of the main body of the first region 110 was formed in a conical shape, and the interface unit 100 having no the protrusion tube 131 was applied.

3) Performing of Experiment

Figure 8:
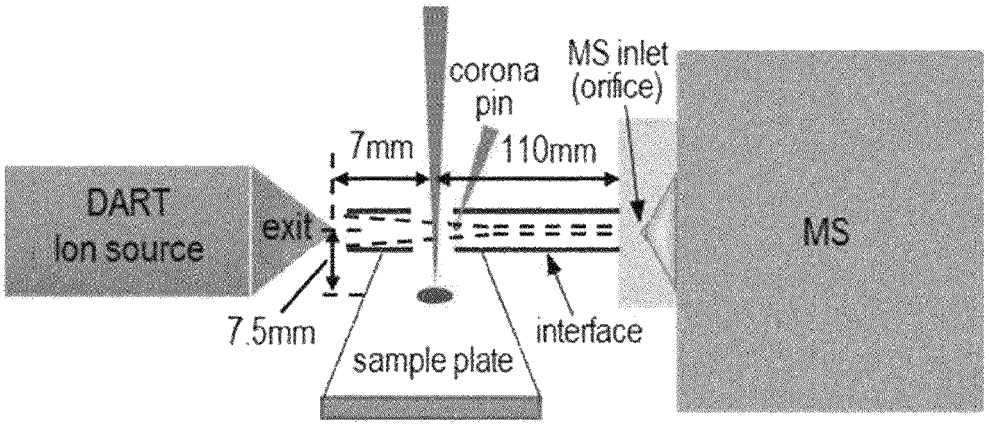
FIG. 8 shows that an experiment is performed in a laser ablation-DART-MS system equipped with the interface unit of FIG. 2.

1 μL of the sample 2 was dropped onto a glass substrate using a pipette. Then, as shown in FIG. 8, the glass substrate was placed on a sample plate to adjust a relative distance between the DART ionization unit 10, the laser beam, the inlet 21 of the mass spectrometry unit 20 and the sample plate. Next, a laser power, a DC voltage, a temperature of the DART source and the mass spectrometry unit 20 were set to the above experimental condition 2). Thereafter, a mass spectrum of the analyte was obtained.

Example 2

Sample Preparation

The Sample prepared in the same manner as in Example 1 was used.

Experimental Condition

A laser power is 180 mW as a continuous wave, a DC voltage ranging from 0 to 1.5 kV is applied to a needle, a temperature of the DART source is 400° C., and the mass spectrometry unit 20 has a positive mode (ionization mode), an FTMS (analyzer) set as 240,000 (resolution). As shown in FIG. 3, the interface unit 100 having a uniform inner diameter in the longitudinal direction without the protrusion tube 131 was applied.

Performing of Experiment

The experiment was carried out by the same experimental method as in Example 1.

Figure 9A:
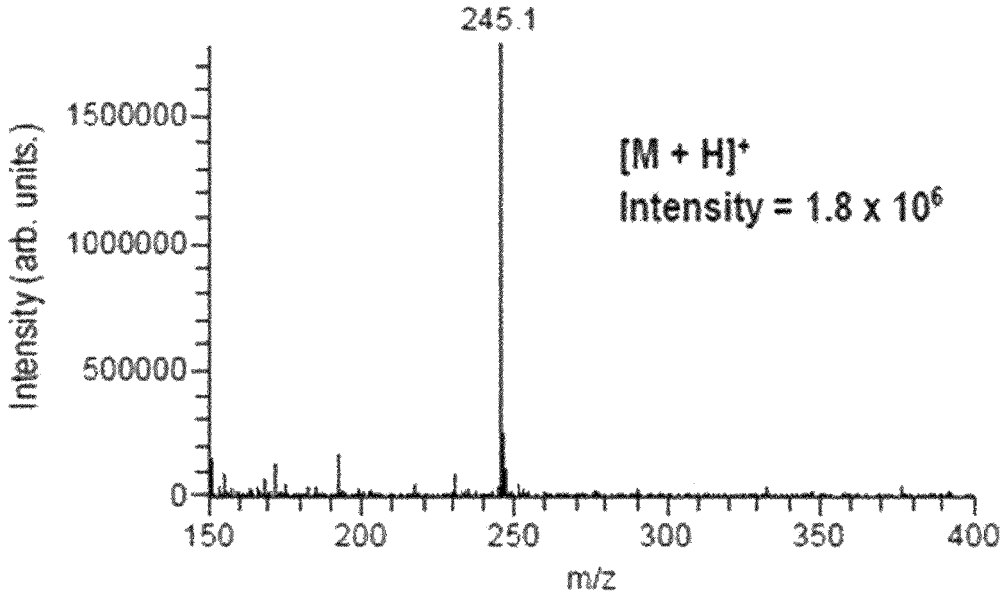
FIG. 9*a* is a graph showing an experimental result in a laser ablation-DART-MS system to which an interface unit is not applied.

FIG. 9*a* is a graph showing an experimental result when the experiment was performed without the interface unit 100 according to the present invention.

Figure 9B:
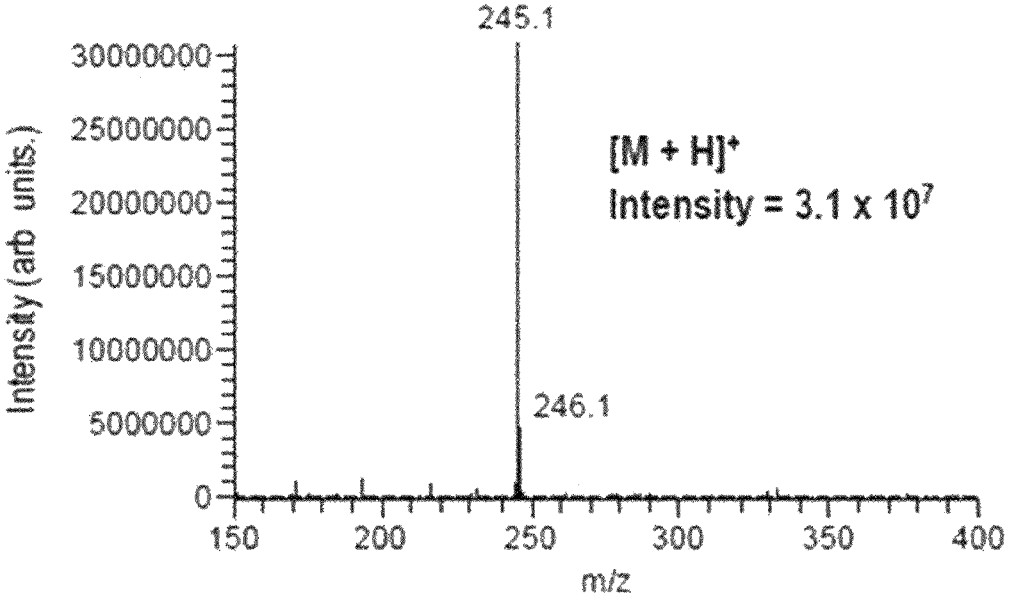
FIGS. 9*b* and 9*c* are graphs showing experimental results in a laser ablation-DART-MS system to which an interface unit is applied.
Figure 9C:
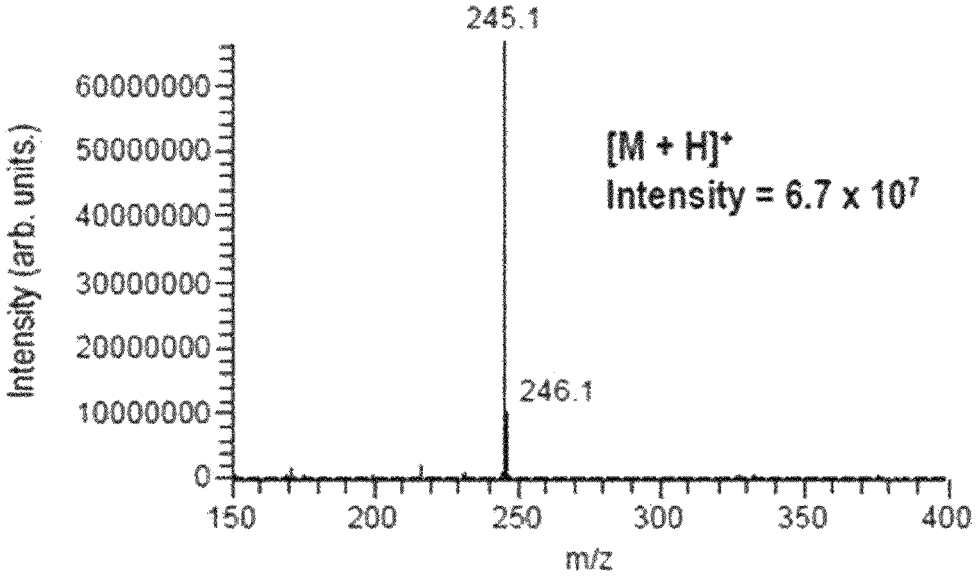

FIG. 9*b* is a graph showing an experimental result of Example 2, and FIG. 9*c* is a graph showing an experimental result of Example 1.

The experimental results of Examples 1 and 2 show that the detection sensitivity of the laser ablation-DART-MS system 1 to which the interface unit 100 of the present invention is applied is more excellent than that of the system without the interface unit 100. Comparison of the experimental result of Example 1 with the experimental result without the interface unit 100 can confirm a difference of about 35 times in the detection sensitivity.

Hereinafter, in the laser ablation-DART-MS system 1 to which the interface unit 100 of the present invention is applied, an optical unit support member 400 for supporting an optical unit 40 including a laser unit 41 will be described in detail.

An interface flange 21*b* is mounted to the mass spectrometry unit 20 so that ions generated by the DART ionization unit 10 are transmitted to the mass spectrometry (MS) unit 20. Specifically, the interface flange 21*b* may be fixed to the surface of the mass spectrometry unit in which an orifice 21*a* is provided.

Figure 12:
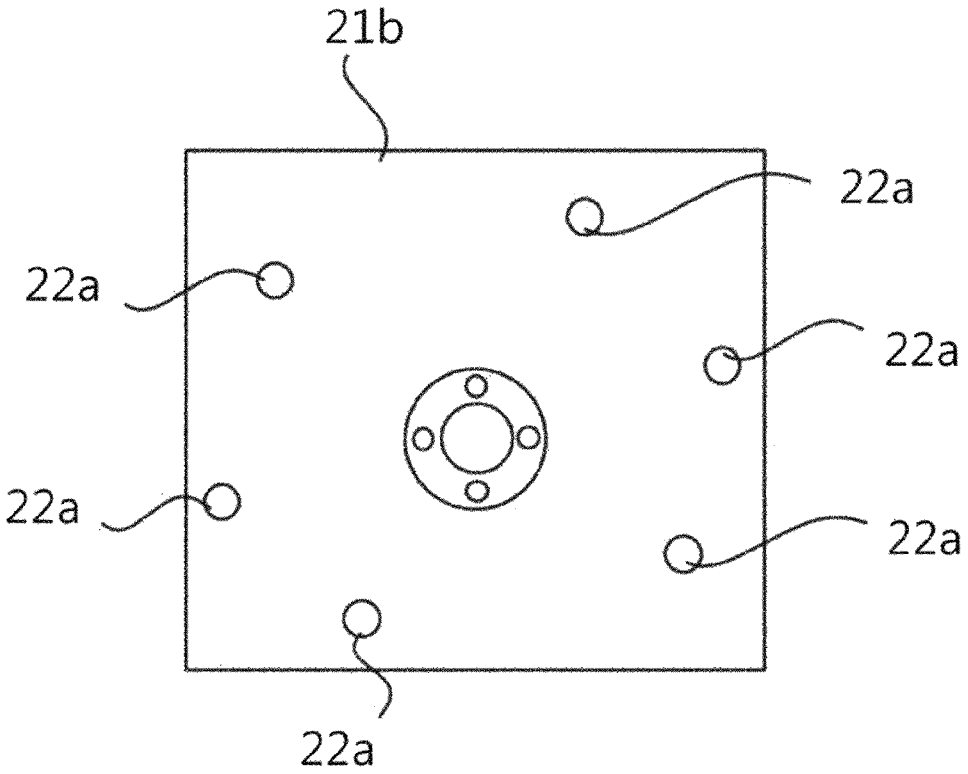
FIG. 12 is a view showing an example of an interface flange.

The interface flange 21*b* may further include a tab portion 22*a* as shown in FIG. 12. The optical unit support member 400 as will be described later may be fixed to the tab portion 22*a* of the interface flange 21*b*. In other words, the interface flange 21*b* may be provided or not be provided with the tab portion 22*a*. If the interface flange 21*b* is not provided with the tab portion 22*a*, the tab portion 22*a* may be formed at a desired position to fix the optical unit support member 400.

Figure 10:
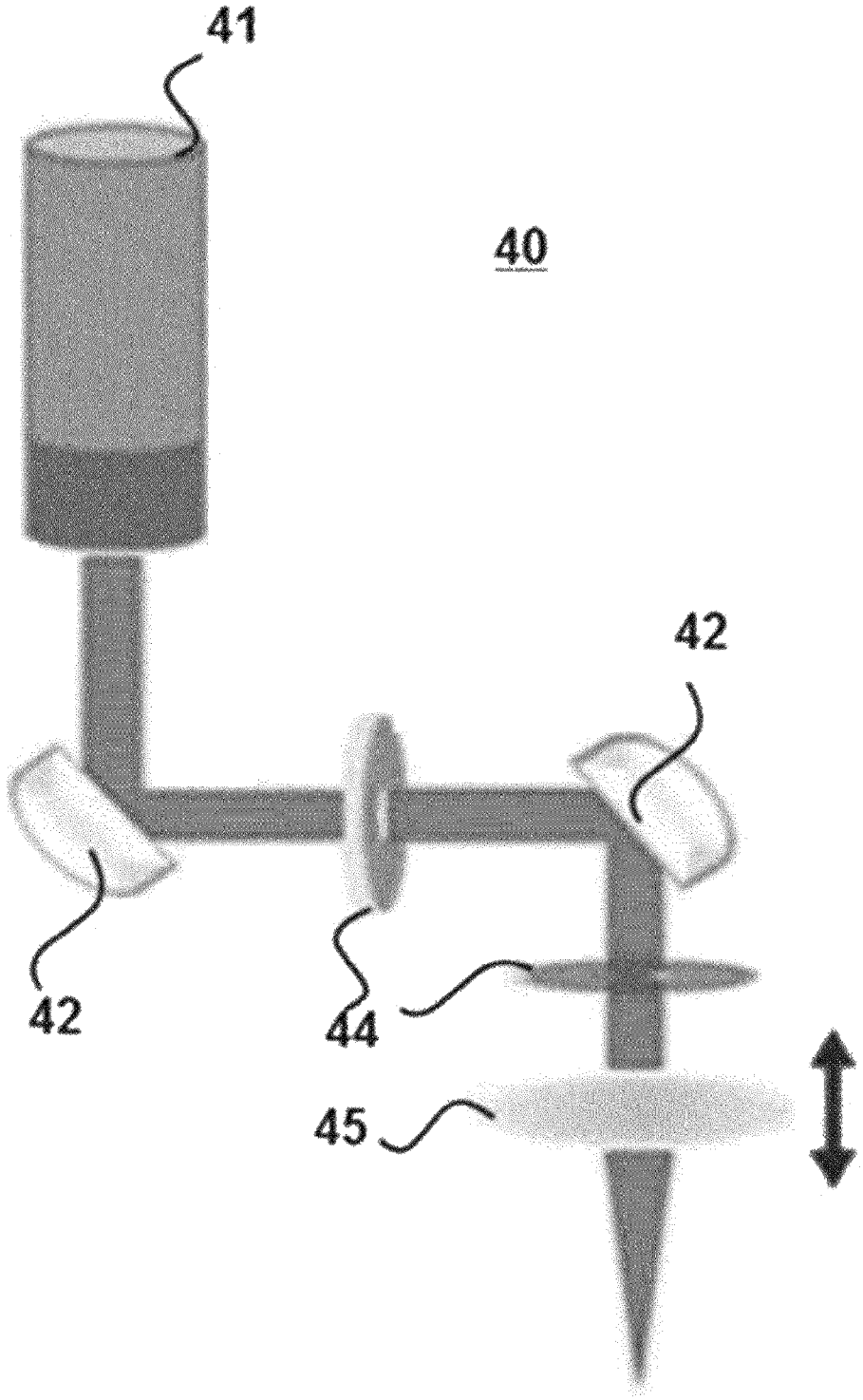
FIG. 10 is a schematic diagram of an optical unit in the laser ablation-DART-MS system of FIG. 1.

FIG. 10 shows a schematic diagram of optical units 40.

The optical units 40 include a laser unit 41, a mirror 42, a translation stage 43, an iris 44, a lens 45, and the like. The laser unit 41 irradiates a sample 2 with a laser beam to ablate an analyte from the sample. In this case, the elements that should be optimized for improving the detection sensitivity are a power of the laser determined by the optical units 40, a distance between the sample 2 and a focal point (that is, the point at which the laser beam is focused in one place by the lens 45), a beam size at an ablation point (that is, the point at which ablation occurs by contacting the laser beam with the sample 2), and the likes. That is, the alignment and focusibility of the laser beam may be adjusted through the optimized arrangement of the optical units 40. Alternatively, when an optical fiber is coupled to the laser module 41, a head portion of the optical fiber may be mounted to the optical unit support member 400 regardless of the size of the laser module 41.

The mirror 42 serves to adjust a path of the laser beam such that the laser beam generated by the laser unit 41 can reach the sample 2. That is, when the laser beam does not reach the straight path from the laser unit 41 to the sample 2, the path of the laser beam is adjusted by changing an advancing direction of the laser beam with at least one mirror 42.

The translation stage 43 can move along at least one axial direction. For example, it may be an XY stage movable on a plane. The lens 45 may be mounted on the translation stage 43 so that the lens 45 may move in a predetermined direction. Thus, the position of the lens 45 can be adjusted to change a focal point of the laser beam on the sample 2. For example, the focal point may be placed on the sample or placed slightly away from the sample.

The iris 44 serves as a guide for aligning the laser beam in a desired path. Further, the beam size may be controlled by adjusting an aperture size of the iris 44.

The lens 45 may adjust the focal point of the laser beam on the surface of the sample 2.

On the other hand, regarding the optical units 40, a relative distance between the focal point of the laser beam and the sample surface may affect the detection sensitivity. If the sample is placed at the focal point, the ablation degree of the sample per area may be high, the ablation area may be reduced, and the detection sensitivity of fragment ions may be higher compared to molecular ions. If the sample is placed at an off-center focal point, the ablation degree of the sample per area may be low. As the off-center focal point increases, the beam size for the sample is larger, and thus the ablation area may be increased, and the detection sensitivity of the molecular ions may be higher compared to the fragment ions. Accordingly, it is required that the optical unit having high detection sensitivity is arranged with optimization by adjusting the positional relationship between the laser unit 41, the lens 45, and the sample in consideration of such a correlation. In addition, even if the optimized positional relationship is established at a specific wavelength and power, the wavelength and power of the laser are factors that greatly affect the detection sensitivity according to the sample, and thus it is necessary to optimize the arrangement of the optical unit depending on sample characteristics and laser characteristics at the time of the experiment. The present invention has an advantage that a plurality of fastening portions 410 are provided on the optical unit support member 400 and the optical units 40 are mounted with the plurality of fastening portions 410 on the optical unit support member 400 in various arrangement and combination manners according to the above-mentioned purposes.

The laser ablation-DART-MS system 1 of the present invention includes the optical unit support member 400 for supporting the optical units 40. The optical unit support member 400 may be manufactured, for example, in a plate shape. In addition, the optical unit support member 400 includes a plurality of fastening portions 410 arranged at predetermined intervals. The plurality of fastening portions 410 may be, for example, an M6 tab or have a through hole shape.

Figure 11:
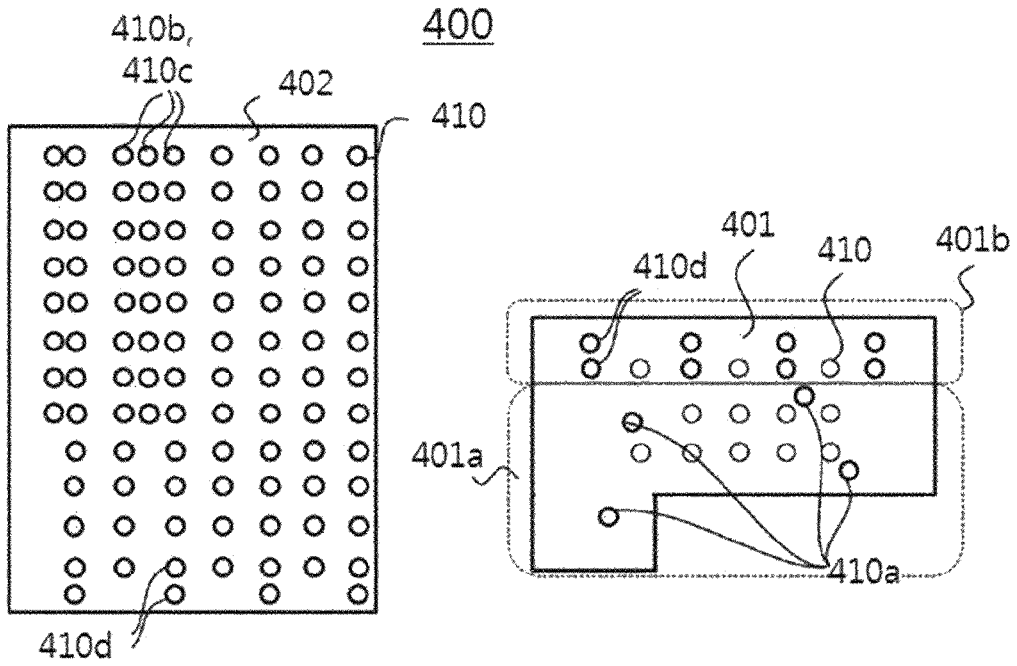
FIG. 11 is a front view of a member for supporting an optical unit.

The plurality of fastening portions 410 include at least two interface flange connecting portions 410*a*. For example, some of the plurality of fastening portions 410 formed at the predetermined intervals may function as the interface flange connecting portion 410*a* or may be provided at a position corresponding to a tab portion 22*a* of the interface flange. For example, the interface flange connecting portion 410*a* as shown in FIG. 11 may be located at a position corresponding to the tab portion 22*a* of the interface flange of FIG. 12. Each interface flange connecting portion 410*a* may be fixed to the tab portion 22*a* of each interface flange with a first fastening member. For example, the tab portion 22*a* of the interface flange may have a female screw shape on an inner circumferential surface thereof and the first fastening member may have a male screw shape on which the inner circumferential surface of the tab portion 22*a* is engaged. The first fastening member may be, for example, an M6 bolt.

Specifically, the optical unit support member 400 is fixed to a front surface of the interface flange 21*b*, in a manner that the optical unit support member 400 is located at a desired position of the front surface of the interface flange 21*b* in the mass spectrometry unit 20, and the first fastening members are inserted into the fastening portions (i.e., the interface flange connecting portions 410*a*) corresponding to the positions of the tab portions 22*a* of the interface flange 21*b* among the plurality of fastening portions 410.

Further, the plurality of fastening portions 410 includes an optical unit connecting portion 410*b*. That is, some of the plurality of fastening portions 410 may function as the optical unit connecting portion 410*b*. The optical units 40 may include the above-described laser unit 41, the mirror 42, the translation stage 43, the iris 44, the lens 45, and the like. Each of the optical units 40 (the laser unit 41, the mirror 42, the translation stage 43, the iris 44, the lens 45, etc.) may include at least one fastening portion for connecting to the optical unit connecting portion 410*b*. The fastening portion may be, for example, in the shape of a through hole, or the inner circumferential surface thereof may be in the shape of a female screw. The fastening portion and the optical unit connecting portion 410*b* of each optical unit 40 may be fixed with a second fastening member. For example, the second fastening member may have the shape of a male screw coupled to the optical unit connecting portion 410*b* and the fastening portion. The second fastening member may be, for example, an M6 bolt or an M6 tanned bolt. Alternatively, when the fastening portion is in the shape of the through hole, for example, the second fastening member may be provided with a nut behind a bolt.

Specifically, each of the optical units 40 is fixed to the optical unit support member 400, in a manner that each of the optical units 40 is arranged at a desired position of the optical unit support member 400 and the second fastening members are inserted into the fastening portions (i.e., the optical unit connecting portions 410*b*) corresponding to those of the optical units 40 among the plurality of fastening portions 410.

Additionally, a corona discharge unit 50 may be fixed to the optical unit support member 400. Similarly, the corona discharge unit 50 may also include at least one fastening portion. For example, the fastening portion may have the shape of a through hole and the through hole may have an inner circumferential surface of a female screw shape. The corona discharge unit 50 may be fixed to a desired position of the optical unit support member 400 in a manner that the corona discharge unit 50 is fixed to the fastening portions (that is, the corona discharge unit connecting portion 410*c*) corresponding to those of the corona discharge unit 50 among the plurality of fastening portions 410 of the optical unit support member 400, with the second fastening member.

On the other hand, the optical unit support member 400 consists of a lower plate 401 and an upper plate 402, the lower plate 401 and the upper plate 402 being combined with each other, as shown in FIG. 11. In this case, some of the plurality of fastening portions 410 may be upper and lower plate coupling portions 410*d*. That is, some of a top portion of the lower plate 401 is overlapped with some of a bottom portion of the upper plate 402, and an overlapped portion between the plurality of fastening portions 410 of the lower plate 401 and the plurality of fastening portions 410 of the upper plate 402 can be fixed with a third fastening member. The third fastening member may, for example, be an M6 bolt. The holes of the lower plate in the upper and lower plate coupling portion 410*d* are perforated in the shape of a counterbore for a M6 bolt so that the head of the M6 bolt does not protrude above the plate. FIG. 11 shows that four holes located at the top row of the lower plate 401 and four holes located at the next row can be the upper and lower plate coupling portions 410*d*. For convenience, the reference numerals are indicated in the leftmost holes. Similarly, four holes located in the bottom row of the upper plate 402 and four holes located in the next row may be the upper and lower plate coupling portions 410*d*. The lower plate 401 is fixed to the tab portion 22*a* of the interface flange 21*b*, and each of the optical units 40 may be fixed at a desired position among the lower plate 401 and the upper plate 402.

Meanwhile, in case the lower plate 401 and the upper plate 402 is implemented to be combined with each other, there is an advantage that the load of the upper plate 402 is dispersed over the bolt and the interface flange 21*b* by allowing the upper plate 402 to be placed on the interface flange 21*b*. In addition, the present invention has an advantage that the dimension of the upper plate 402 may be freely changed according to the size and configuration of the optical units 40.

The optical unit support member 400 may be made of, for example, a metal, or the like, and made of a stainless steel, an aluminum, or the like.

Figure 13:
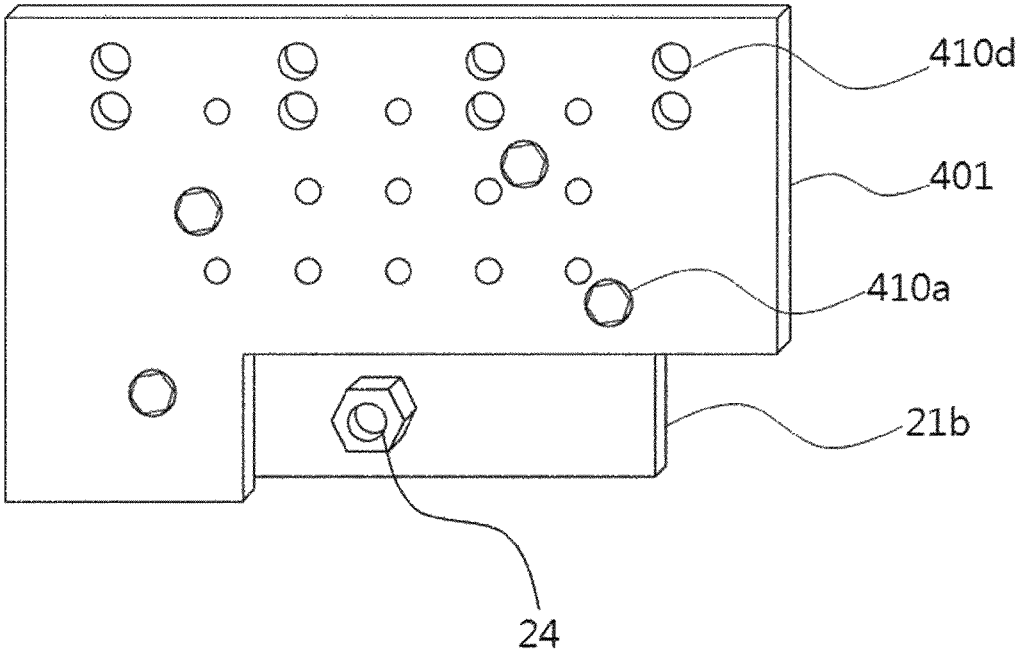
FIG. 13 is a view illustrating that a lower plate is mounted on an interface flange.

Hereinafter, embodiments of the present invention will be described in detail with reference to FIGS. 11 to 14. FIG. 12 is a front view illustratively showing an interface flange 21*b* that may be used in the laser ablation-DART-MS system 1 of FIG. 1, and FIG. 13 is a view showing that a lower plate 401 is mounted on the interface flange 21*b* of FIG. 12. As shown in FIG. 12, the interface flange 21*b* includes a tab portion 22*a*.

Figure 14:
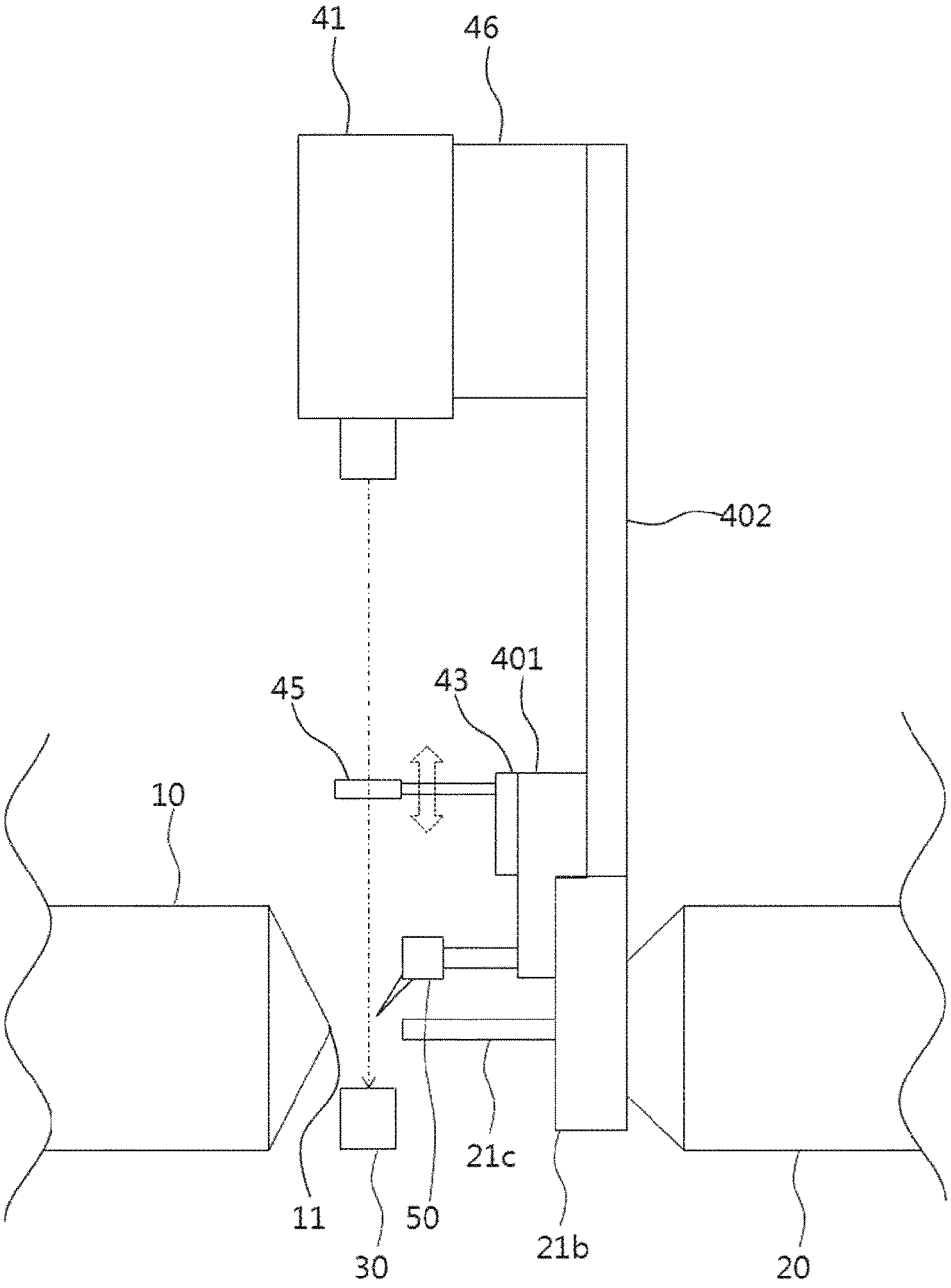
FIG. 14 is a conceptual diagram showing that a member for supporting optical units and a part of the optical units are mounted on an interface flange.

Further, FIG. 14 is a conceptual diagram showing that a member 400 for supporting an optical unit and the optical units 40 are mounted on an interface flange 21*b*.

The lower plate 401 has, for example, width×height×thickness of 190 mm×130 mm×10 mm or 15 mm, respectively. The lower plate 401 is composed of a first portion 401*a* connected to the interface flange 21*b* and having a thickness of 10 mm, and a second portion 401*b* connected to the upper plate 402 and having a thickness of 15 mm. The reason having the different thicknesses as such is that the second portion 401*b* at the lower portion is made slightly thicker so that the upper plate 402 is positioned further inward in order to secure a minimum distance between the laser beam irradiated onto the sample and the mass spectrometry unit 20 as short as possible. In other words, the shorter a distance between the ablation point of the sample and the mass spectrometry unit 20 is, the shorter a distance that the ionized components move to the mass spectrometry unit 40 is, so that less loss during movement allows higher detection sensitivity. The distance between the mass spectrometry unit 20 and the ablation point of the sample may be extended as desired through a spacer 46 according to an environment in which the present invention is implemented, but reduction of the distance may be limited depending on a size of the laser unit 41 and a dimension of the optical unit support member 400. Thus, the second plate 401*b* may be made slightly thicker so that the upper plate 402 may be positioned inward in order to minimize the limitation due to the dimension of the optical unit support member 400. Referring to FIG. 11, the first portion 401*a* and the second portion 401*b* are shown in dashed lines for convenience. The shape of the lower plate 401 may be variously modified and changed to conform to the structure or shape of the interface flange 21*b* coupled to the mass spectrometry unit 20. The upper plate 402 has, for example, width×height×thickness of 190 mm×310 mm×10 mm. The lower plate 401 and the upper plate 402 may be, for example, made of an aluminum material.

Further, a plurality of fastening portions 410 is arranged, for example, at the intervals of 12.5 mm or 25 mm such that the optical units 40 can be installed cross the lower plate 401 and the upper plate 402. The interface flange connecting portion 410*a* is provided in a position corresponding to the tab portion 22*a* of the interface flange of FIG. 12, and the interface flange connecting portion 410*a* is, for example, four.

However, the present invention is not limited to the above-described embodiments, and the intervals, positions, and numbers of the plurality of fastening portions 410 may be variously changed to conform with positions of the tab portions 22*a* in the interface flange 21*b* or a setting of the optical units 40.

An extension tube 21*c* may be connected to a suction port 24 formed in the interface flange 21*b*. One end of the extension tube 21*c* may be connected to the suction port 24, and the other end of the extension tube 21*c* may extend in a direction apposite to an exit 11 of the DART ionization unit 10. The interface unit 100 may be connected to the other end of the extension tube 21*c* or be directly coupled to an inlet 24 of the interface flange 21*b* without the extension tube 21*c*.

The other end of the extension tube 21*c* may be spaced apart from the exit 11 of the DART ionization unit 10 by a certain distance, thereby enabling the laser beam irradiated from the laser unit 41 to be irradiated to the sample mounting unit 30 side without any interruption. That is, the extension tube 21*c* may extend to a distance that does not invade an optical path of the laser beam. By providing the extension tube 21*c*, it is possible to reduce an amount of ionized analytes that are lost before they are introduced into the mass spectrometry unit 20.

It will be appreciated that the technical configuration of the present invention described above may be embodied in other specific forms by those ordinarily skilled in the technical field to which the invention belongs without changing the technical spirit or essential features of the present invention. Therefore, the embodiments described above should be understood to be illustrative in all respects and not restrictive. Further, the scope of the present invention is shown by the claims to be described below, rather than the above detailed description of the specification. In addition, it should be construed that all changes or modifications derived from the meaning and range of the claims and equivalent concepts thereof are included in the scope of the present invention.

INDUSTRIAL APPLICABILITY

According to the present invention, a laser ablation-DART-MS system can improve detection sensitivity by introducing a quartz tube interface between an exit of a DART ionization unit and an inlet of a MS unit to restrict flow of ablated components and generated ions at an irradiation point of each laser beam.

A main body of a first region according to the present invention is formed to be narrower as it is adjacent to a second region, whereby a helium gas emitted from the DART ionization unit and an analyte ablated from a sample are collected in a sufficient amount to be focused and transmitted to the second region together with the generated ionic components. An inner diameter of the main body in the second region is formed to be equal to or smaller than an inner diameter of the main body in the other end side of the first region, so that a gas stream transferred from the first region is delivered to the inlet of the mass spectrometry (MS) unit in a radial compression state, and thus the components to be analyzed can be efficiently collected and transferred.

According to the present invention, the laser ablation-DART-MS system can enhance reproducibility of an experiment by fixing a relative positional relationship between the laser and the sample. In addition, there is an advantage that can optimize the system for improving the detection sensitivity of the sample by adjusting positions of the optical units such as a laser unit using a laser support member. Further, it is possible to increase convenience of the equipment operation of the laser ablation-DART-MS system.

What is claimed is:

1. An interface unit comprising:

a tube-shaped main body located between an exit of a DART (Direct Analysis in Real Time) ionization unit and an inlet of a MS (Mass Spectrometry) unit;

a first opening provided on one side surface of the main body, the first opening being configured to receive into the main body an analyte ablated from a sample; and a second opening configured to receive therethrough a laser beam emitted from a laser unit, the second opening being located at a point in another side of the main body opposite to the first opening, the first opening and the second opening being configured to receive therethrough the laser beam irradiated to the sample, wherein the interface unit is configured to be used in a laser ablation-DART-MS system, and the main body is configured to receive and transfer to the mass spectrometry unit a helium beam emitted from the DART ionization unit and the analyte ablated from the sample.

2. The interface unit according to claim 1, further comprising one or more third openings configured to receive insertion of an end of a corona pin therethrough into the main body, wherein the third openings are located near the second opening.

3. The interface unit according to claim 2, wherein the main body includes a first region configured to receive the helium beam emitted from the DART ionization unit and the analyte ablated from the sample, and a second region that is connected to the first region and configured to receive a gas stream injected from the first region to transfer the helium beam and the analyte to the mass spectrometry unit, and wherein one end of the first region is configured to receive the helium beam emitted from the DART ionization unit, another end of the first region being connected to the second region, and an inner diameter of the main body in the first region is reduced from the one end of the first region toward the another end of the first region.

4. The interface unit according to claim 3, wherein an internal space of the main body is tapered.

5. The interface unit according to claim 3, wherein the first opening is provided in the first region of the main body.

6. The interface unit according to claim 5, further comprising a protrusion tube extending from the first opening toward a sample mounting unit and extending perpendicular to a longitudinal direction of the interface unit, wherein when the sample is mounted on the sample mounting unit, the interface unit is configured to receive the analytes ablated from the sample through the protrusion tube and then through the first opening.

7. The interface unit according to claim 5, wherein the second opening is located in first region of the main body.

8. The interface unit according to claim 7, wherein the first region is provided with at least one or more third openings configured to receive insertion of a corona pin therethrough into the main body.

9. The interface unit according to claim 3, wherein the inlet of the mass spectrometry unit includes an orifice configured to receive the analyte therethrough into an analysis space inside the mass spectrometry unit, the inlet further including an interface flange connected to the orifice, and wherein one end of the second region is connected to the another end of the first region, the another end of the second region is connected to the inlet of the mass spectrometry unit, and an outer diameter of the body in another end of the second region is smaller than an inner diameter of a suction hole in the interface flange that faces the orifice.

10. The laser ablation-DART-MS system comprising the interface unit according to claim 1, the laser ablation-DART-MS system comprising:

a sample mounting unit configured to receive the sample mounted thereon;

an optical unit including the laser unit configured to irradiate the laser beam to the sample to ablate the sample;

the DART ionization unit configured to emit the helium beam to ionize the analyte ablated from the sample;

the mass spectrometry (MS) unit configured to perform analysis of the analyte after it is ionized; and an optical unit support member that supports the optical unit at a desired position, wherein the optical unit support member is fixed to the mass spectrometry unit.

11. The laser ablation-DART-MS system according to claim 10, wherein an inlet of the mass spectrometry unit includes an orifice configured to receive the analyte therethrough into an analysis space inside the mass spectrometry unit, the inlet further including an interface flange connected to the orifice, the interface flange being fixed to a surface of the mass spectrometry unit having the orifice, the optical unit support member being fixed to the interface flange.

12. The laser ablation-DART-MS system according to claim 11, wherein the optical unit support member includes a plurality of fastening portions, the plurality of fastening portions including at least one interface flange connecting portion, each interface flange connection portion being provided at a corresponding tab portion of the interface flange, each interface flange connecting portion being coupled to the corresponding tab portion of the interface flange with a first fastening member.

13. The laser ablation-DART-MS system according to claim 12, wherein the plurality of fastening portions further includes at least one optical unit connecting portion to which the optical unit is coupled, each optical unit connecting portion being coupled to a corresponding fastening portion of the optical unit with a second fastening member, the optical unit further including at least one of a mirror, a translation stage, an iris, and a lens.

14. The laser ablation-DART-MS system according to claim 12, wherein the optical unit support member consists of an upper plate and a lower plate, the plurality of fastening portions includes at least one upper plate coupling portion and at least one lower plate coupling portion to which the upper plate and the lower plate are coupled with each other, and the optical unit support member has a third fastening member fixed at a position at which the upper plate coupling portion and the lower plate coupling portion overlap.

* * * * *